United States Patent [19]

Barrett et al.

[11] 4,006,629

[45] Feb. 8, 1977

[54] TORQUE MEASURING APPARATUS

[75] Inventors: Gary L. Barrett, Milford; Ralph S. Shoberg, Farmington, both of Mich.

[73] Assignee: GSE, Inc., Farmington Hills, Mich.

[22] Filed: July 17, 1975

[21] Appl. No.: 596,914

[52] U.S. Cl. ..... 73/139

[51] Int. Cl.[2] ..... B25B 23/14

[58] Field of Search ..... 73/141 A, 139; 177/211

[56] References Cited

UNITED STATES PATENTS

| | | | |
|---|---|---|---|
| 3,650,340 | 3/1972 | Bradley | 177/211 X |
| 3,724,575 | 4/1973 | Kutsay | 73/141 A X |
| 3,895,517 | 7/1975 | Otto | 73/139 |
| 3,927,560 | 12/1975 | Farr | 73/141 A |

OTHER PUBLICATIONS

The Strain Gage Primer, Second Edition, McGraw–Hill Book Co., pp. 230–232.

*Primary Examiner*—Charles A. Ruehl
*Attorney, Agent, or Firm*—Thomas N. Young

[57] ABSTRACT

A torque measuring apparatus having a head adapted to rotate about an axis of rotation and a lever arm extending from the head and perpendicular to the axis of rotation designed to react to normal forces applied at a distance from the head. On the lever arm are a plurality of strain transducers spaced apart a certain distance as determined in accordance with predetermined mechanical properties of the lever arm. The transducers are joined electrically to form a bridge circuit, the output of which is directly proportional to the torque on the workpiece. This output is then transmitted to a display for a visual presentation of the torque.

11 Claims, 4 Drawing Figures

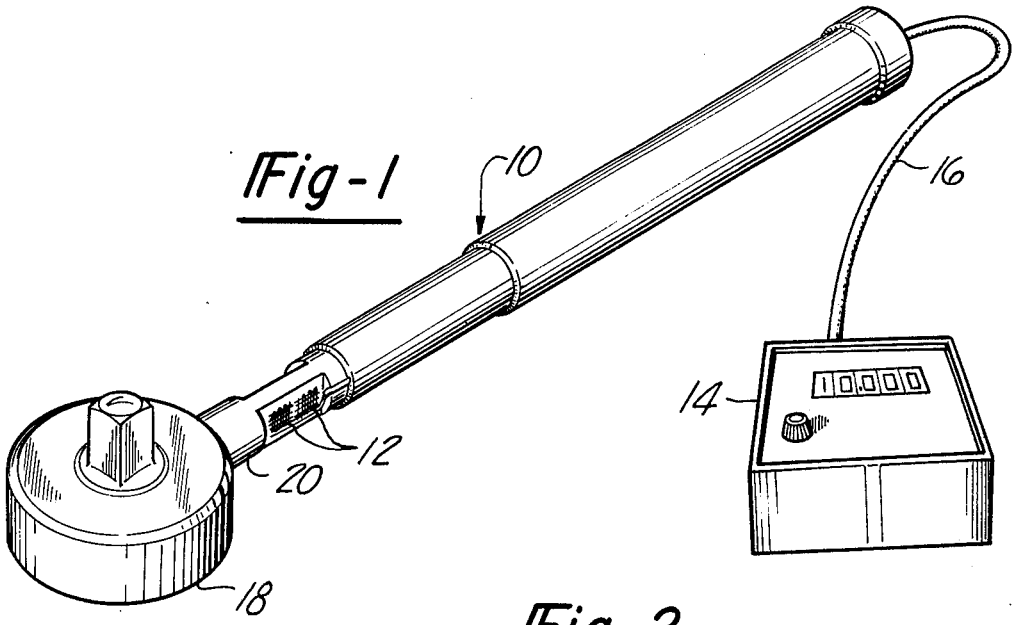
Fig-1
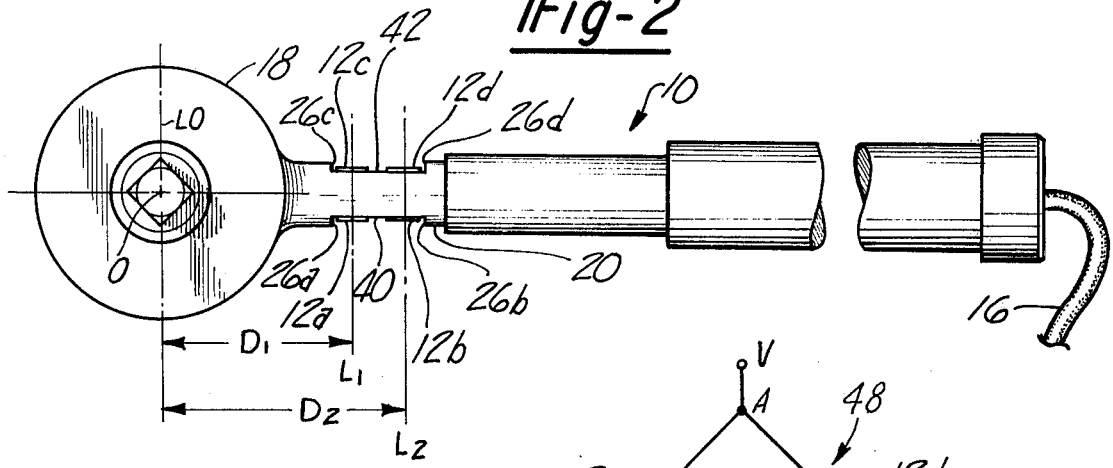
Fig-2
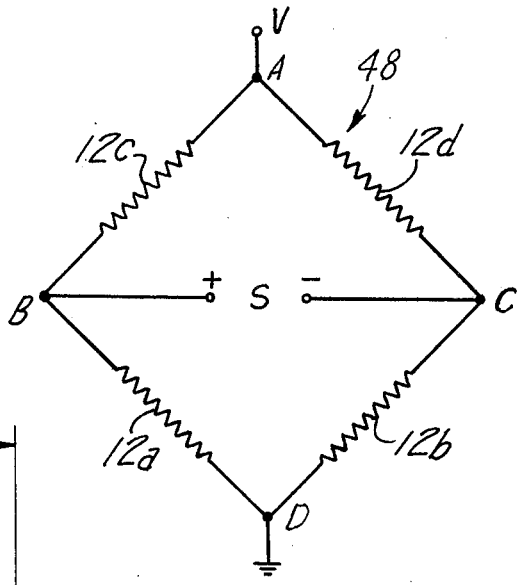
Fig-3
Fig-4
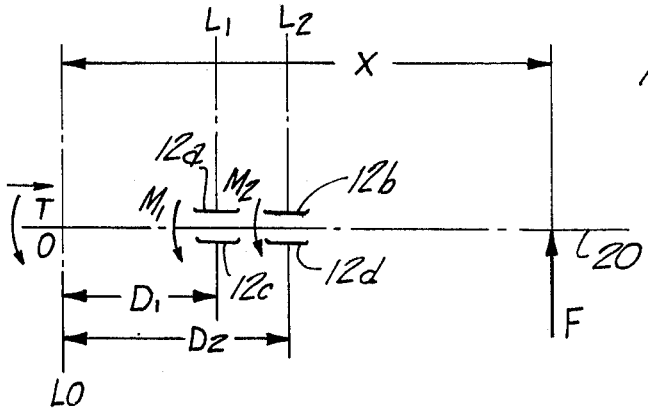

TORQUE MEASURING APPARATUS

INTRODUCTION

This invention relates to torque measuring devices and more particularly to a torque measuring device wherein the torque is measured through a network of strain transducers and presented on an electrical display.

BACKGROUND OF THE INVENTION

There are many occasions where the torque to be applied to a rotational workpiece must be measured with a high degree of precision. A common example is a machine assembly where the members must be joined and fastener together securely, but with a limited amount of stress between one another.

Devices have been designed to measure torque on a rotational workpiece. Generally, they all have a head suited to rotate coaxially and in cooperation with the workpiece and a lever arm extending from the head and perpendicular to the axis of rotation for reacting to forces acting at a distance from the head.

In the cases where the actuating force that produces torque is applied to the lever arm, the device acts as a torque wrench. Torque is then determined through measuring the resultant elastic strain in the lever arm. Alternatively, the device may operate passively, where in contrast to the wrench, the torque actuating force is not applied directly to the device. In this instance, as the device rotates the lever arm encounters a reactionary force, often a spring loaded stop, which causes elastic strain in the arm. Again, the torque is determined through measuring these strains.

One of the major design difficulties has been to develop an apparatus that will give an accurate measurement of torque irrespective of the point of force application on the lever arm. Prior art solutions to this problem have involved the use of strain transducers, typically strain gages, placed on the lever arm at selected points to sample the elastic strain and to determine therefrom the torque existing at the axis of rotation. The transducers are usually arranged in one or more bridge circuits, the outputs of which are related to the applied torque. The bridges necessary to provide the desired output have been of relatively sophisticated design, requiring groups of eight or more transducers. This high level of complexity has reflected itself in increased cost, maintenance and quality control problems.

Thus, it has become desirable to develop an improved torque measuring device of simpler design, but yet without sacrificing accuracy. Such is the objective of the present invention.

BRIEF SUMMARY OF THE INVENTION

The present invention relates to a torque measuring device which, whether embodied as a torque wrench or a torque transducer, will allow the torque applied to a rotational workpiece to be measured directly through a simplified network of strain transducers, irrespective of the point at which an actuating or a reactive force is applied to the wrench handle or transducer lever arm.

Basically this is accomplished with an apparatus having a head suited for coaxial and cooperative rotation with the workpiece and a handle or lever arm extending from the head for reacting to normal forces applied at a distance from the head. The lever arm is provided with transducer means for sensing elastic strain at two sensing points on the arm and translating the strain into corresponding electrical signals. The two sensing points are spaced a certain distance from one another in accordance with known mechanical properties of the lever arm so as to allow the difference between the electrical signal values corresponding to the strain at the sensing points to be directly proportional to the torque applied to the workpiece. The difference in signal value is then transmitted directly to a display unit, without any intermediate calculations, where it causes the measure of applied torque to be displayed to the operator.

Further modifications and additions to the basic inventive concept will be set forth in greater detail in the following description wherein reference is made to the drawings in which:

FIG. 1 is a perspective view of a torque wrench embodying the present invention;

FIG. 2 is a plan view of the wrench of FIG. 1 that more fully illustrates the relation between the wrench and the transducer network;

FIG. 3 is a schematic representation of the network defined by the electrical interconnection of the strain gages of FIG. 2; and, FIG. 4 is a mathematical model of the wrench and transducer system of FIG. 2 used to analyze the operation of the present invention.

DETAILED DESCRIPTION OF THE SPECIFIC EMBODIMENT

The present invention is illustrated in FIG. 1 in the context of a torque wrench. It is to be understood that this is only illustrative of one of the many applications of this invention. The invention is not limited to application in this context. Rather, it is merely presented as the mode of operation in which the inventive concept may be most readily understood.

The torque wrench 10 can be seen in FIG. 1 to take the general form of a socket wrench with a head 18 and a handle 20. Bonded to the handle 20 is a network of strain gage transducers 12 which detect elastic strain in the handle and translate the strains into corresponding electrical signals. The output of the transducer network is in turn transmitted to the display means 14 through cable 16.

THE WRENCH

As shown in FIG. 2 the wrench 10 is a metallic integral body, preferably of tool steel, comprising a head 18 and a handle 20. The head is adapted to engage a socket (not shown) for turning a threaded member having a polygonal head (not shown). On the handle 20, in proximity to the area in which the head 18 joins the handle, are two parallel planar surfaces 40 and 42 machined out of the handle. The provision of surfaces 40 and 42 in the handle 20 defines a plurality of abrupt steps 26 A, B, C and D, as well as a stress concentration area.

In the present invention the wrench 10 is characterized by two mechanical parameters, the modulus of elasticity, E, and the section modulus Z. The modulus of elasticity is the ratio of the incremental stress to incremental strain and is an intrinsic property of the metal from which the wrench is fabricated. The section modulus is a measure of the bending stiffness at points along the longitudinal axis of the wrench handle 20, and is defined by: $Z = I/D$, where $I$ = the moment of inertia at a point along the longitudinal axis of the handle 20, and D = the distance from the neutral plane between surfaces 40 and 42 to the extreme fiber of either surface 40 or 42. The significance of this latter parameter will be made more apparent further along in the discussion.

THE TRANSDUCER SYSTEM

The transducer system is shown in FIG. 2 to comprise a group of four strain gages 12 A, B, C and D bonded to opposing surfaces 40 and 42 on the handle 20. Gages 12A and B are preferably bonded to the surface 40 which experiences tensile strains upon the application of a torque producing force on handle 20. Gages 12C and D act as compression gages and are bonded to the surface 42 which simultaneously experiences opposing compression strain under the same force.

Elastic strains in surfaces 40 and 42 cause concomitant strains in the gages 12 A, B, C and D. The strain in the gages is manifested as a linearly proportional change in their electrical resistances. This phenomonen allows the strain gages 12 A, B, C and D to be employed as devices that detect mechanical strain and translate it into an electrical signal. Each of the gages 12 A, B, C and D is characterized by two parameters; the nominal gage resistance, R, and the gage factor, GF. Both of these values are supplied by the manufacturer. The nominal gage resistance, R, is the resistance of the gage when it is in a quiescent state. The gage factor, GF, is defined as the unit change in resistance per unit change in strain, or, stated alternatively: $GF = (\Delta R/R) / (\Delta L/L)$; where $\Delta R$ = the incremental resistance caused by the strain, R = the nominal gage resistance, and $\Delta L$ = the incremental strain, and L = the nominal gage length. To get the unit strain as a direct function of the incremental resistance, the expression for the gage factor is rearranged to yield: $\Delta L/L = (\Delta R/R) / GF$. For greatest design convenience, strain gages 12 A, B, C and D may be constrained to have coequal values for the L and R parameters. Favorable results have been obtained where gages 12A and C have nominal resistances of 350 ohms with gage factors of 4.5, and gages 12 B and D have nominal resistances of 350 ohms with gage factors of 2.0. Strain gages suitable for operation with the present invention are available from Dentronics, Inc., 1800 Series.

In FIG. 2 gages 12A and C have a center line shown as L1; gages 12B and D have a center line shown as L2. The distances from L1 and L2 to the center line L0 passing through the axis of rotation, 0, are respectively shown as D1 and D2. For reasons that will be made more clear and purposeful in the discussion describing the operation of the subject invention, strain gages 12 A, B, C and D are constrained to be spaced on the handle 20 such that the following relationship is satisfied: $(D1 \cdot GF\,1) / (Z1) = (D2 \cdot GF\,2) / (Z2)$; where GF 1 is the gage factor of gages 12 A and C, GF 2 is the gage factor of gages 12 B and D, Z1 is the section modulus at the section defined by line L1, and Z2 is the section modulus at the section defined by line L2.

The three variables, section moduli, gage sensitivity and gage spacing may all be modified to suit design considerations, so long as the preceding relationship remains satisfied.

THE WHEATSTONE BRIDGE

To get an accurate determination of the change in the resistance of the strain gages 12 A, B, C, and D resulting from the strain in the wrench handle 20, the gages are connected electrically to form a Wheatstone bridge, shown generally at 48 in FIG. 3. The bridge 48 is defined by four terminals A, B, C and D. Branch A–B comprises strain gage 12C; branch B–D comprises gage 12A; branch A–C comprises gage 12D; and branch C–D comprises gage 12B. An electromotive force, V, nominally 10 volts DC, is impressed across terminals A–D and the corresponding output, S, is taken by measuring the potential difference between terminals B and C.

In practice it is often times desirable to add dummy resistors of relatively small resistance value in series with one or more strain gages in the bridge arms to modify their gage factors in compensation for tolerances in the physical components of the bridge network.

When no actuating or reactive force is applied to the wrench handle 20 the bridge 48 is in balance. Stated algebraically, that is $R_{12A} = (R_{12C}/R_{12D}) \cdot R_{12B}$; where R denotes the nominal resistance value of the strain gage identified by the subscripts.

When a torque producing force is applied to the wrench handle 20 the gages are caused to experience elastic strain. The strains in gages 12A and 12C are equal and opposite, as are the strains in gages 12B and 12D. If gages 12A and C are constrained to have equal gage factors, GF1, then the changes in resistance values in gages 12A and 12C will be equal and opposite. By similarly constraining gages 12B and 12D to have equal gage factors, GF2, their changes in resistance values will likewise be equal and opposite. The changes in resistance values corresponding to the strains can be determined from the definition of the gage factor, $GF = (\Delta R/R) / (\Delta L/L)$. Rearranging this expression yields: $\Delta R = GF\,(\Delta L/L)\,(R)$. But as indicated earlier, strain gages 12 A, B, C and D all have known, predetermined values for L and R. Hence, the incremental resistance is principally a function of the product of the gage factor and incremental strain.

The bridge output, S, is defined as the voltage difference between terminals B and C. To determine the voltages at terminals B and C conventional circuit theory is applied. The voltage at terminal B associated with an incremental resistance change $\Delta R1$ in gages 12 A and C is found as:

$$V_B = V \cdot \frac{R + \Delta R1}{2R}.$$

The voltage at terminal C associated with an incremental resistance change $\Delta R2$ in gages 12 B and D is found as:

$$V_C = V \cdot \frac{R + \Delta R2}{2R}.$$

The output signal, S, is defined as:

$$S = V_B - V_C = (V/2 \cdot R)\,[(R + \Delta R1) - (R + \Delta R2)] = (V/2 \cdot R)\,(\Delta R1 - \Delta R2).$$

But since R, L and V are all known quantities, the expression may be simplified to: $S \alpha\ (GF1 \cdot \Delta L1) - (GF2 \cdot \Delta L2)$. Stated gramatically, the output voltage is directly proportional to the difference of the products of the gage factor and strain at the two respective sensing points on the wrench handle 20.

THE DISPLAY

The bridge output, S, is the corresponding input for the display means 14. The display is shown in FIG. 1 to be a remote modular unit that receives an input voltage through cable 16 and presents a corresponding digital read-out. This working arrangement allows the user of the present invention to have a direct and unimpaired view of the amount of torque being applied, independent of the orientation of the wrench 10. A display module suitable for operation in this application is manufactured by GSE, Inc., Model 228D.

OPERATION

The operation of the present invention may be best understood by reference to the mathematical model of FIG. 4.

As a torque producing force, F, is applied to the wrench handle, represented here as line 20, a torque, T, is created about the axis of rotation, O. Assuming that the force F is normal to the handle 20, the torque T is determined by the relationship: $T = FX$, were $X =$ the distance from the axis of rotation to the point of force application. In a similar manner, the force F also produces a moment at all points between the axis of rotation and the point of force application. The moment at the section of the handle 20 defined by the centerline L1 of gages 12A and 12C is designated M1, and is determined from the relationship: $M1 = F \cdot (X - D1)$. The moment at the section of the handle 20 defined by the centerline L2 of gages 12B and 12D is designated M2, and is determined from the relationship: $M2 = F \cdot (X - D2)$.

The existence of moments M1 and M2 creates an elastic strain in the wrench handle at the points at which the moments are measured. Strain is related to the moment through the section modulus, Z, i.e., the aforementioned parameter that is a measure of the bending stiffness of a section on the wrench handle, and the modulus of elasticity, E. The expression showing this relationship is $\Delta L = M/(Z \cdot E)$ where $\Delta L$ is the strain. Therefore, the strain at the section defined by centerline L1 is: $\Delta L1 = M1/(Z1 \cdot E)$, and the strain at the section defined by centerline L2 is: $\Delta L2 - M2/(Z2 \cdot E)$.

In accordance with the earlier discussion relating to the output voltage, S, of the Wheatstone bridge 48 of FIG. 3, it was determined that S was proportional to the difference of the products of the gage factor and strain at the two respective sensing points defined by lines L1 and L2. This may be stated mathematically as: $S\alpha\ (GF1 \cdot \Delta L1) - (GF2 \cdot \Delta L2)$. Substituting in the expressions for the incremental strain yields:

$$S\alpha\ (GF1 \cdot M1 / Z1 \cdot E) - (GF2 \cdot M2 / Z2 \cdot E)$$

Substituting in the expressions for M1 and M2 yields:

$$S\alpha\ (GF1 \cdot F\,(X - D1) / Z1 \cdot E) - (GF2 \cdot F(X - D2) / Z2 \cdot E)$$

Multiplying out the factors yields:

$$S\alpha\ (GF1 \cdot F \cdot x / Z1 \cdot E) - (GF1 \cdot F \cdot D1 / Z1 \cdot E) - (GF2 \cdot F \cdot x / Z2 \cdot E) + (GF2 \cdot D2 / Z2 \cdot E)$$

Substitution of $T = F \cdot X$, and rearranging yields:

$$S\alpha\ (T/E)\ (GF1 / Z1 - GF2 / Z2) + (T/E \cdot X)\ (GF2 \cdot D2 / Z2 - GF1 \cdot D1 / Z1)$$

But, as stated earlier, the spacing of the strain gages on the handle has been constrained such that:

$$(GF2 \cdot D2/Z2) = (GF1 \cdot D1/Z1).$$

Therefore, the expression reduces to:

$$S\alpha\ (T/E)\ (GF1/Z1 - GF2/Z2)$$

However, GF1, GF2, Z1, Z2 and E are all known constants. Thus, the expression may be put most simply as: $S\ \alpha\ T$.

The result is that the output signal of the transducer network is directly proportional to the torque applied to the axis of rotation, without regard for the point of force application, so long as it is outboard of line L2 of FIG. 4. Thus, the output S of bridge 48 may be supplied directly to the display means 14. There is no need for intervening computational operations.

SUMMARY

In the preceding discussion of the illustrative embodiment, the inventive concept has been applied to a torque wrench. This application has shown how a network of strain gage transducers that are spaced in accordance with predetermined mechanical properties of the wrench, can be joined electrically to form a bridge circuit that has an output directly proportional to the torque applied to a rotational workpiece and, moverover, independent of the point of force application on the handle.

The presentation of the invention in the context of a torque wrench should not be deemed limiting. The invention may also perform in the context of passive torque measuring device. In such an application, the device is disposed to rotate in cooperation with the workpiece in a manner similar to the wrench, but in contrast to the wrench, the torque producing force is not applied to the lever arm, but rather through separate means. As the device rotates in cooperation with the workpiece, the lever arm will be caused to encounter and react against a normal force, such as spring loaded stop. The opposing normal force, acting at a distance from the head would cause the existence of moments along the lever arm. Measurement of strain in a manner similar to the torque wrench would allow the torque existing at the axis of rotation of the transducer head to be ascertainable. Again, the transducer will operate independent of the point at which the normal force acts against the lever arm.

The invention makes a significant advancement over prior art apparatus in that it makes optimal use information relating to the physical attributes of the structure to provide a torque measurement device that is markedly simpler than prior art designs, but yet has functional capabilities equal to the more complex designs.

The embodiments of the invention in which an exclusive property or privilege is claimed are defined as follows:

1. A point of force compensated transducer for measuring the torque on a rotational workpiece having an axis of rotation comprising: an integral body having a head for rotating co-axially and in cooperation with the rotational workpiece, and a lever arm extending from the head and perpendicular to the axis of rotation for reacting to forces acting normal to the lever arm and at a distance from the head; first and second transducer means operatively attached to the lever arm at respective first and second sensing points along the longitudinal axis of the lever arm for sensing elastic strain in the lever arm and translating it into a corresponding electrical signal; the first and second sensing points being spaced from one another so as to satisfy the relationship $$GF1 \cdot D1/Z1 = DF2 \cdot D2/Z2.$$

where: D1 and D2 are the respective distances from the first and second sensing points to the intersection of the longitudinal axis of the lever arms and a line mutually perpendicular to both the axis of rotation and the longitudinal axis of the lever arm, Z1 and Z2 are the respective section moduli of the first and second sensing points, and GF1 and GF2 are the respective sensitivities of the first and second transducer means; and means for measuring the difference between the electrical signal values corresponding to the elastic strain at the first and second sensing points in order to provide an electrical output signal directly proportional to the torque on the rotational workpiece.

2. The transducer as defined in claim 1 wherein the first transducer means comprises first and second strain gages, the first and second gages being positioned at the first sensing point and operatively attached to the respective first and second opposing surfaces of the lever arm subject to elastic strain, the second transducer means comprises third and fourth strain gages, the third and fourth gages being positioned at the second sensing point and operatively attached to the respective first and second opposing surfaces of the lever arm subject to elastic strain, and the difference measuring means comprises a four terminal (A, B, C, D) bridge comprising the first, second, third and fourth strain gages joined electrically such that branch A–B comprises the first gage, branch B–D comprises the second gage, branch A–C comprises the third gage and branch C–D comprises the fourth gage and means for impressing an electromotive force across terminals A–D of the bridge, the electrical signal output being taken as the potential difference across terminals B–C.

3. A transducer as defined in claim 1 which further comprises display means for receiving the output of the difference measuring means and translating it into a visual presentation of the torque on the rotational workpiece.

4. A transducer as defined in claim 3 wherein the visual presentation of the display means is digital.

5. A transducer as defined in claim 3 wherein the electrical output signal of the difference measuring means is communicated to the display means through an electrical cable, thereby allowing the display means to be located remotely from the body of the transducer.

6. A torque wrench comprising: an integral metallic body having a head adapted to engage and turn a workpiece about an axis of rotation, and a handle extending from the head and perpendicular to the axis of rotation for reacting to force applied normally to the handle and at a distance from the head; first and second transducer means operatively attached to the handle at first and second sensing points along the longitudinal axis of the handle for sensing elastic strain in the handle and producing a corresponding electrical signal, the first and second sensing points being spaced from one another so as to satisfy the relationship:

$$GF1 \cdot D1/Z1 = GF2 \cdot D2/Z2$$

where: D1 and D2 are the respective distances from the first and second sensing points to the intersection of the longitudinal axis of the handle and a line mutually perpendicular to both the axis of rotation and the longitudinal axis of the handle, Z1 and Z2 are the respective section moduli of the first and second sensing points, and GF1 and GF2 are the respective sensitivities of the transducer means; means for measuring the difference between the electrical signal values corresponding to the elastic strain at the first and second sensing points so as to provide an electrical output signal directly proportional to the torque as the rotational workpiece; and, display means for receiving the electrical output signal and translating it into a visual presentation of the torque on the workpiece.

7. A wrench as defined in claim 6 wherein the first transducer means comprises first and second strain gages, the first and second gages being positioned at the first sensing point and operatively attached to the respective first and second opposing surfaces of the handle subject to elastic strain, the second transducer means comprises third and fourth strain gages, the third and fourth gages being positioned at the second sensing point and operatively attached to the respective first and second opposing surfaces of the handle subject to elastic strain, and the difference measuring means comprises a four terminal (A, B, C, D) bridge comprising the first, second, third and fourth strain gages joined electrically such that branch A–B comprises the first gage, branch B–D comprises the second gage, branch A–C comprises the third gage and branch C–D comprises the fourth gage, and means for impressing an electromotive force across terminals A–D of the bridge, the electrical signal output being taken as the potential difference across terminals B–C.

8. A wrench as defined in claim 6 wherein the electrical output signal of the difference measuring means is communicated to the display means through an electrical cable, thereby allowing the display means to be located remotely from the body of the wrench.

9. A wrench as defined in claim 6 wherein the visual presentation of the display means is digital.

10. A wrench as defined in claim 6 wherein the first and second sensing points are located on a neck portion of the handle proximate the head, having opposing planar faces machined from the handle surfaces subject to elastic strain.

11. A wrench as defined in claim 6 wherein the electrical output signal is communicated to the display means through an electrical cable, thereby allowing the display means to be located remotely from the handle.

* * * * *